US006577047B2

(12) United States Patent
Ohmae et al.

(10) Patent No.: US 6,577,047 B2
(45) Date of Patent: Jun. 10, 2003

(54) CATHODE RAY TUBE

(75) Inventors: Hideharu Ohmae, Osaka (JP); Yoshikazu Demi, Shiga (JP); Masayoshi Ozaki, Hyogo (JP); Mitsunori Yokomakura, Osaka (JP); Masayuki Ohmori, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 341 days.

(21) Appl. No.: 09/746,358

(22) Filed: Dec. 21, 2000

(65) Prior Publication Data

US 2002/0011788 A1 Jan. 31, 2002

(30) Foreign Application Priority Data

Dec. 21, 1999 (JP) ..... 11-362949
Dec. 28, 1999 (JP) ..... 11-374898

(51) Int. Cl.[7] ..... H01J 29/80

(52) U.S. Cl. ..... 313/402; 313/403; 313/407; 313/408

(58) Field of Search ..... 313/402, 403, 313/407, 408, 404, 405, 406

(56) References Cited

U.S. PATENT DOCUMENTS

| | | | | |
|---|---|---|---|---|
| 3,872,345 A | * | 3/1975 | Yamazaki et al. | 313/403 |
| 4,926,089 A | | 5/1990 | Moore | |
| 5,280,215 A | | 1/1994 | Ohtake et al. | |
| 5,583,391 A | | 12/1996 | Good et al. | |
| 5,631,520 A | | 5/1997 | Inoue et al. | |
| 5,856,725 A | | 1/1999 | Ueda | |
| 6,124,668 A | | 9/2000 | Shoda | |

FOREIGN PATENT DOCUMENTS

| | | | |
|---|---|---|---|
| EP | 0 487 106 | | 5/1992 |
| FR | 2 801 136 | | 5/2001 |
| GB | 2 351 600 | | 1/2001 |
| JP | 63-119139 | | 5/1988 |
| JP | 1-320738 | | 12/1989 |
| JP | 9-265916 | | 7/1997 |
| JP | 2002203490 | * | 7/2002 |

OTHER PUBLICATIONS

European Search Report, Jan. 7, 2002.

* cited by examiner

*Primary Examiner*—Robert H. Kim
*Assistant Examiner*—Elizabeth Gemmell
(74) *Attorney, Agent, or Firm*—Merchant & Gould, P.C.

(57) ABSTRACT

A cathode ray tube capable of reducing the doming amount and suppressing the occurrence of moire stripes at the same time with improved effects to suppress the occurrence of moire stripes even more is provided. The protruding portions 28*a*, 28*b* are protruding from the ends of the horizontal direction of the aperture to the inside of the aperture 27. With regard to the horizontal cross sections of the protruding portions 28*a*, 28*b*, the portions facing each other left and right via the aperture are formed to be asymmetrical to the center line 29 in order to reduce or block the incident electron beam. By forming the protruding portions 28*a*, 28*b*, the doming amount can be reduced and the occurrence of moire stripes can be suppressed at the same time. Furthermore, by forming the portions facing each other left and right of the protruding portions asymmetrically, the effects to suppress the occurrence of moire stripes can be improved even more.

9 Claims, 8 Drawing Sheets

CATHODE RAY TUBE

FIELD OF THE INVENTION

The present invention relates to a cathode ray tube having a shadow mask, which is used for a television receiver, a computer display, and the like.

BACKGROUND OF THE INVENTION

FIG. 6 is a cross-sectional view showing one example of a conventional color cathode ray tube. The color cathode ray tube 1 shown in FIG. 6 includes a substantially rectangular-shaped face panel 2 having a phosphor screen on its inner face, a funnel 3 connected to the rear side of the face panel 2, an electron gun 4 contained in a neck portion 3*a* of the funnel 3, a shadow mask 6 facing a phosphor screen 2*a* inside the face panel 2, and a mask frame 7 for fixing the shadow mask 6. Furthermore, in order to deflect and scan electron beams, a deflection yoke 5 is provided on the outer periphery of the funnel 3.

The shadow mask 6 plays a role of selecting colors with respect to three electron beams emitted from the electron gun 4. "A" shows a track of the electron beams. The shadow mask 6 has a flat plate provided with a number of substantially slot-shaped apertures formed by etching. The slot-shaped aperture is a through aperture through which electron beams pass.

In a color cathode ray tube, due to the thermal expansion caused by the impact of the emitted electron beams, the electron beam through aperture is shifted. Consequently, a doming phenomenon occurs. That is, the electron beams passing through the electron beam through apertures fail to hit a predetermined phosphor correctly, thus causing unevenness in colors. Therefore, a tension force to absorb the thermal expansion due to the temperature increase of the shadow mask is applied in advance, and then the shadow mask is stretched and held to the mask frame. When the shadow mask is stretched and held as mentioned above, even if the temperature of the shadow mask is raised, it is possible to reduce the amount of displacement between an aperture of the shadow mask and phosphor stripes of the phosphor screen.

FIG. 7 is a plan view showing an example of a shadow mask to which a tension force is applied mainly in the vertical direction of the screen. In FIG. 7, the direction indicated by arrow x is the horizontal direction of the screen, and the direction indicated by arrow y is the vertical direction of the screen. Apertures 8 are formed at constant pitches. Reference numeral 9 is referred to as a bridge, which is a portion between respective apertures 8. The bridge width has an effect on the mechanical strength of the shadow mask. More specifically, the bridge with a narrow width has a weak tension force particularly in the horizontal direction. If the bridge width is increased in order to improve the mechanical strength, the open area of the aperture is reduced, thus deteriorating the luminance intensity.

As mentioned above, the bridge width is related to the mechanical strength and the luminance intensity of the shadow mask, whereas the vertical pitch of the bridge is related to the doming amount of the shadow mask. The shadow mask is stretched mainly in the vertical direction. Therefore, the thermal expansion in the vertical direction is absorbed by the tension force, while the thermal expansion in the horizontal direction is transmitted in the horizontal direction through the bridges.

FIG. 8 is a graph showing an example of the relationship between the vertical pitch of the bridge and the doming amount (an example of a cathode ray tube for a 25-inch television is shown). FIG. 8 shows that the doming amount can be reduced by increasing the vertical pitch of the bridge.

However, the conventional color cathode ray tube suffers from the following problem. The doming amount can be reduced by increasing the vertical pitch of the bridge. In this case, however, moire stripes easily occur, thus causing the deterioration of the image quality. The moire stripe means a mutual interference stripe between scanning lines (luminescent lines) of the electron beams arranged at constant intervals and the regular pattern of the electron beam through apertures of the shadow mask.

Furthermore, when the vertical pitch of the bridge is increased, the bridges themselves may appear as dots on the screen, or may be recognized as a pattern in which the bridges are piled up (a brick-like pattern).

On the contrary, when the vertical pitch of the bridge is reduced, moire stripes are suppressed sufficiently and the bridges themselves are not noticeable. However, due to the increase of the shielding area of the scanning lines, the luminance property deteriorates, and at the same time, the doming amount is increased. Namely, it was difficult to suppress the doming amount and the occurrence of moire stripes at the same time.

SUMMARY OF THE INVENTION

It is an object of the present invention to solve the conventional problems described above by providing a cathode ray tube including a shadow mask of a tension system in which protruding portions are formed in apertures to reduce the doming amount and to suppress the occurrence of moire stripes at the same time.

To achieve the above object, a first cathode ray tube of the present invention includes a shadow mask made of a flat plate provided with a number of apertures and bridges between the neighboring apertures arranged in the vertical direction, wherein protruding portions protruding from the both ends of the horizontal direction of the aperture to the inside of the aperture are formed in the shadow mask, and a tip of the protruding portion is wider than a base of the protruding portion. According to the cathode ray tube described above, by forming the protruding portions, the vertical pitch of the bridge is maintained at a large value, while the occurrence of moire stripes can be suppressed in the same manner as the vertical pitch of the bridge is reduced. Furthermore, the tips of the pair of the protruding portions facing each other are formed separately, so that the thermal expansion in the horizontal direction is not transmitted between the protruding portions, and the doming can be prevented. In other words, it is possible to reduce the doming amount and also to suppress the occurrence of moire stripes at the same time. In addition, since the tip of the protruding portion is wider than the base, it is possible to suppress the deterioration of luminance while securing the shielding effect against the electron beams.

In the first cathode ray tube, it is preferable that the width of the protruding portion gradually increases from the base to the tip.

Furthermore, it is preferable that the tip of the protruding portion is extending more in the vertical direction than the base.

Next, a second cathode ray tube of the present invention includes a shadow mask made of a flat plate provided with a number of apertures and bridges between the neighboring apertures arranged in the vertical direction, and an electron beam passes through the apertures, wherein protruding portions protruding from the both ends of the horizontal direction of the aperture to the inside of the aperture are formed in the shadow mask, and a horizontal diameter of the electron beam passing through the aperture is smaller than a shortest distance in the horizontal direction between the portions facing each other via the aperture in the area where the protruding portions are formed at least in the vicinity of both edges of the shadow mask in the horizontal direction. According to the cathode ray tube described above, by forming the protruding portions, it is possible to reduce the doming amount and also to suppress the occurrence of moire stripes at the same time. Moreover, the cathode ray tube of the present invention also has improved effects to suppress the occurrence of moire stripes.

In the second cathode ray tube, it is preferable that the portions facing each other via the aperture in the area where the protruding portions are formed have horizontal cross sections asymmetrical to the center line of the aperture that is perpendicular to the surface of the shadow mask. According to the aforementioned cathode ray tube, the protruding portions are formed asymmetrically, so that the effects to suppress the occurrence of moire stripes can be improved even more.

Furthermore, it is preferable that the protruding portions are protruding from the both ends of the horizontal direction of the aperture to the inside of the aperture, and that tips of the protruding portions are facing each other.

Furthermore, it is preferable that one of the portions of the protruding portions facing each other via the aperture is an external wall portion positioned on the outer side of the shadow mask having a back inclining portion in the horizontal cross section inclining from a tip portion toward the outer side of the shadow mask as it approaches the back side of the shadow mask, and that the tip portion is positioned closer to the front side of the shadow mask than the center of the shadow mask in the thickness direction.

According to the aforementioned cathode ray tube, the position of the tip portion is shifted closer to the front side of the shadow mask, so that the effects to suppress the occurrence of moire stripes can be improved even more.

Furthermore, it is preferable that one the portions of the protruding portions facing each other via the aperture is an internal wall portion positioned on the inner side of the shadow mask having a front inclining portion in the horizontal cross section inclining from a tip portion toward the inner side of the shadow mask as it approaches the front side of the shadow mask, and that the tip portion of the external wall portion is positioned closer to the front side of the shadow mask than the tip portion of the internal wall portion.

Furthermore, it is preferable that the following inequality is satisfied, where an incident angle (°) of an electron beam is $\alpha$ ($\alpha>0$) in reference to the line vertical to the surface of the shadow mask; a shortest distance (mm) in the horizontal direction between the portions facing each other via the aperture of the protruding portions is SB; a displacement (mm) between the tip portion of the external wall portion and the tip portion of the internal wall portion in the thickness direction of the shadow mask is $\Delta Z$; and {1−(a horizontal diameter (mm) of the electron beam passing through the aperture)/(the shortest distance (mm) in the horizontal direction between the portions facing each other via the aperture)}×100 is a shielding rate B (%):

$$\sin\{90^\circ-\alpha-(\tan^{-1}\Delta Z/SB)\}\times(SB^2+\Delta Z^2)^{1/2}\leqq(1-B/100)\times SB.$$

DETAILED DESCRIPTION OF THE INVENTION

Figure 6:
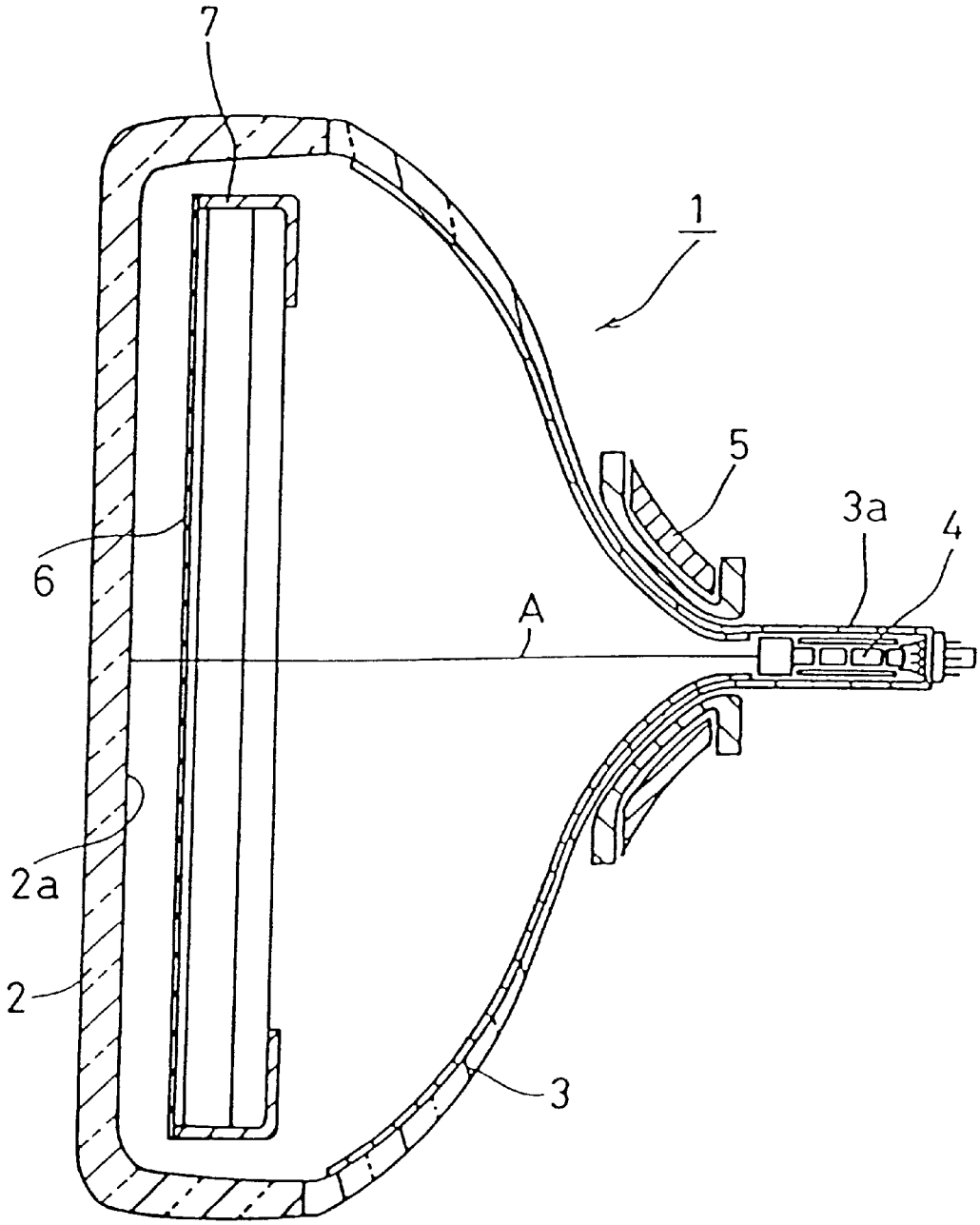
FIG. 6 PRIOR ART
FIG. 6 is a cross-sectional view showing an example of a conventional color cathode ray tube.
Figure 7:
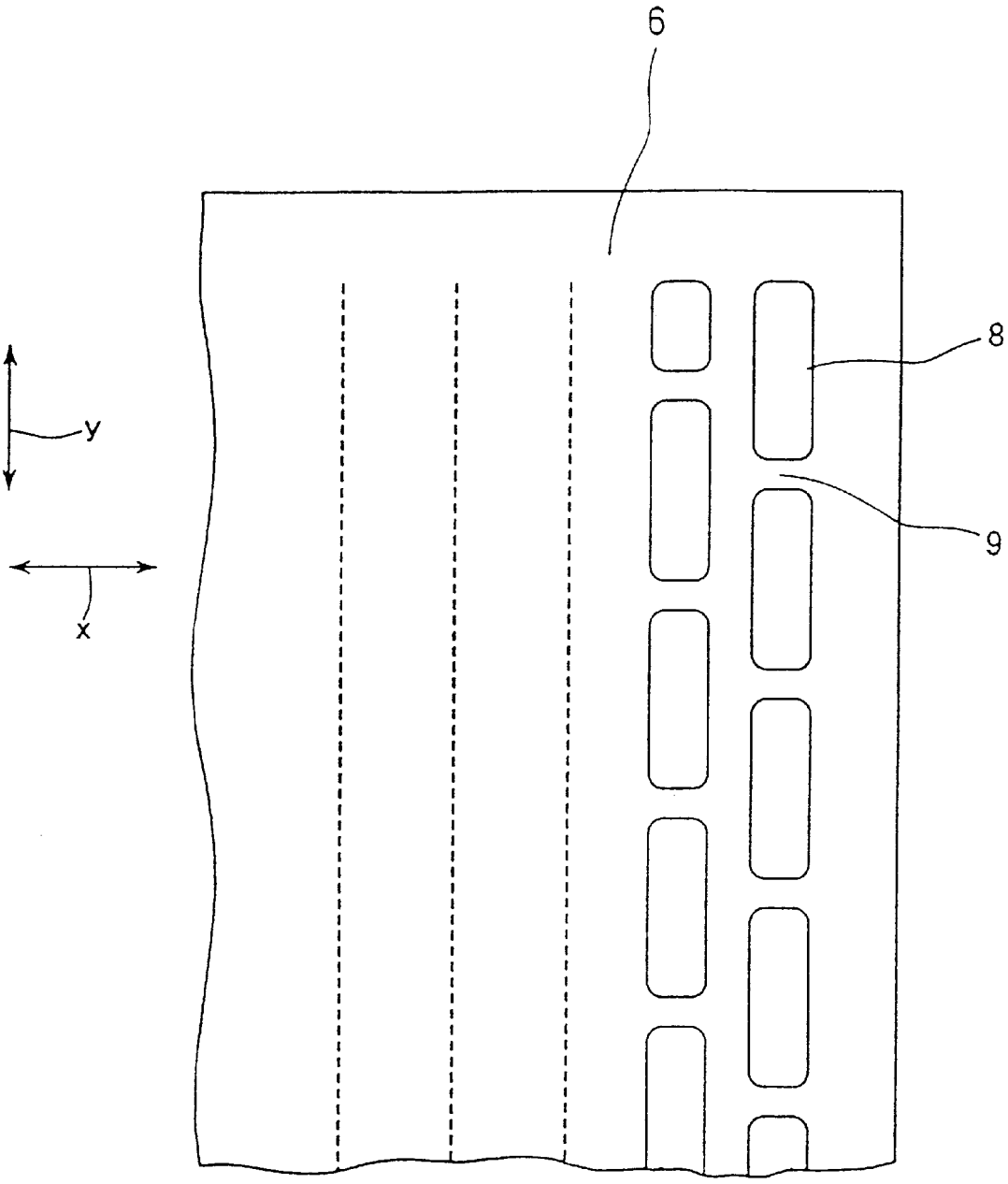
FIG. 7 PRIOR ART
FIG. 7 is a plan view showing an example of a conventional shadow mask.

Hereinafter, the present invention will be described by way of an embodiment with reference to drawings. Since each constitution of the color cathode ray tube described with reference to FIG. 6 is the same as that in this embodiment, the explanations thereof are not repeated herein.

EXAMPLE 1

Figure 1:
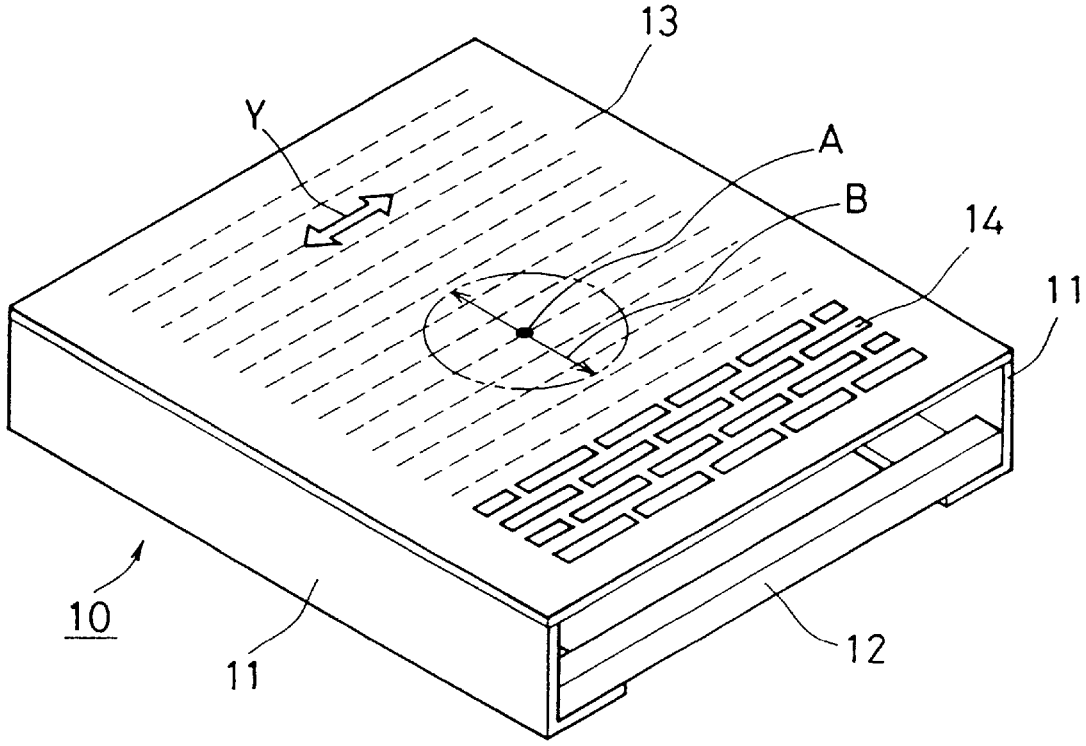
FIG. 1 is a perspective view showing a color-selecting electrode of one embodiment of the present invention.

FIG. 1 is a perspective view showing a color-selecting electrode of one embodiment according to the present invention. A mask frame 10 is a rectangular frame and is made of a pair of long frame supports 11, facing each other, fixed to a pair of short frames made of elastic members 12. On the shadow mask 13, apertures 14, through which electron beams pass, are formed by etching. The aperture 14 is provided with protruding portions to be explained later in detail, which are not shown in this drawing. In this drawing, a tension method is employed, and the shadow mask 13 is stretched and held between the supports 11 with a tension force applied mainly in the direction illustrated by arrow Y.

Figure 2A:
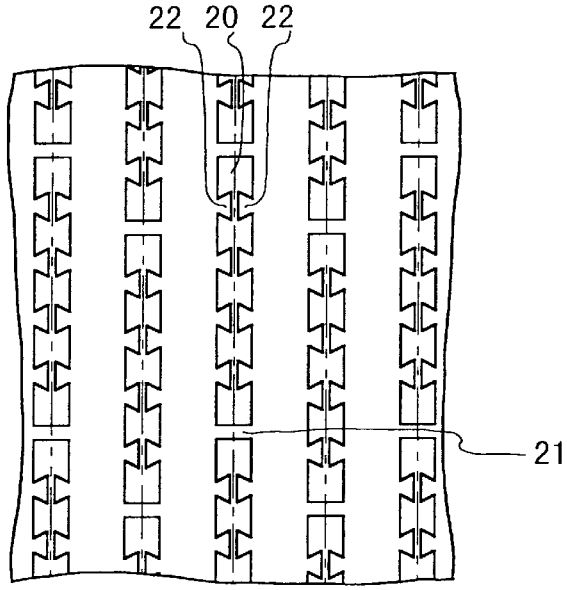
FIGS. 2A–C are plan views showing a shadow mask of Example 1 of the present invention.
Figure 2B:
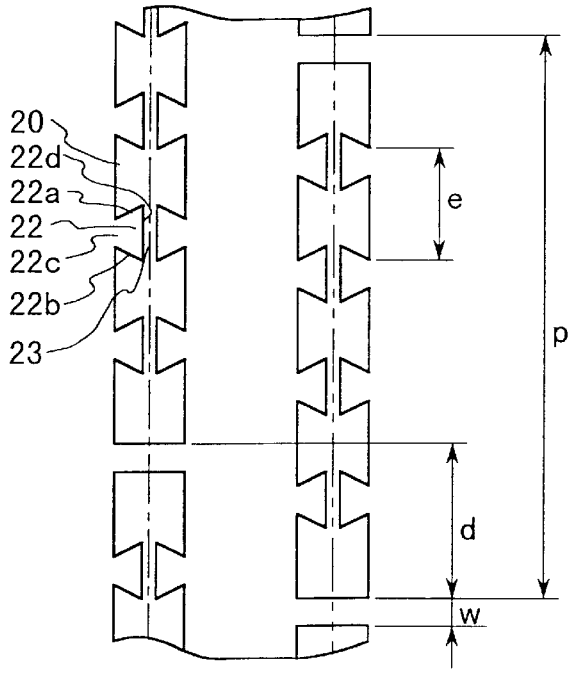
Figure 2C:
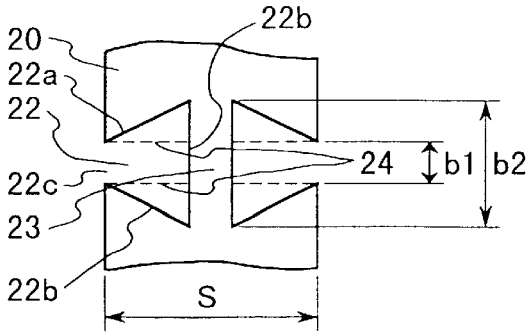

FIG. 2A is a plan view showing one embodiment of a shadow mask. FIG. 2B is an enlarged view of one portion in FIG. 2A. FIG. 2C is an enlarged view of a protruding portion 22. In the drawing, the vertical (longitudinal) direction is the vertical direction of the screen and the horizontal (transverse) direction is the horizontal direction of the screen. Apertures 20 neighboring in the vertical direction are linked by a bridge 21. In the aperture 20, a plurality of a pair of the protruding portions 22 are formed. These pairs of the protruding portions 22 are protruding from the both ends of the horizontal direction of the aperture 20. The protruding portions 22 are arranged facing each other at their tips. Since the tips of the protruding portions 22 are formed separately, the aperture 20 is narrowed in the area where these pairs of the protruding portions 22 are formed.

Figure 8:
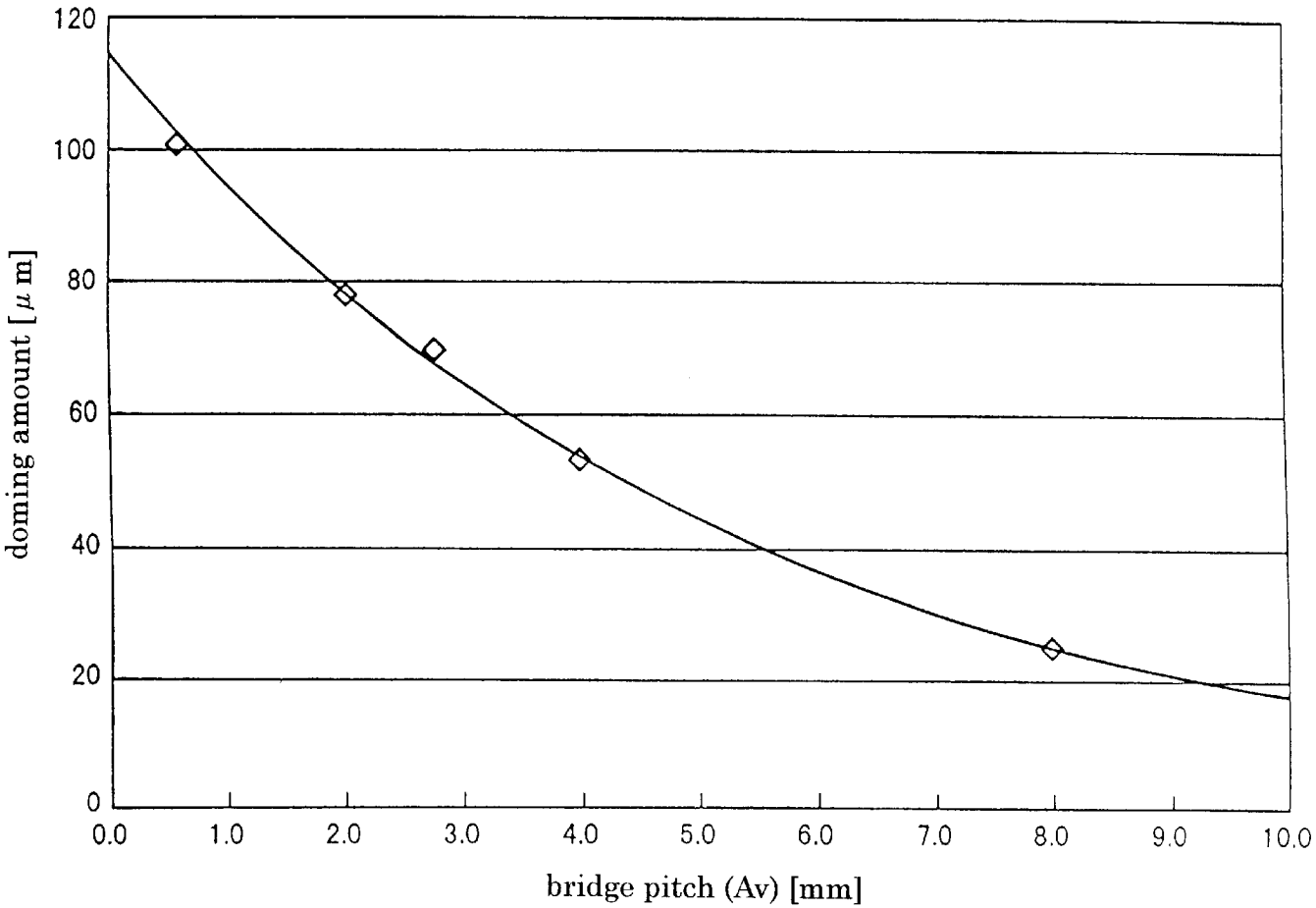
FIG. 8 PRIOR ART
FIG. 8 is a graph showing an example of the relationship between the vertical pitch of the bridge and the doming amount.

Here, as is clear from the graph showing the relationship between the vertical pitch of the bridge and the doming amount in FIG. 8, if the vertical pitch of the bridge is increased, the doming can be suppressed to a low amount. Furthermore, if the vertical pitch of the bridge is increased, the open area of the aperture also is increased, thus improving the luminance property. However, if the vertical pitch of the bridge is increased in this way, this causes the occurrence of moire stripes, so that the vertical pitch of the bridge needs to be reduced in order to suppress the occurrence of moire stripes.

Furthermore, for example, if the area of the bridge is reduced to suppress the deterioration of the luminance property, the mechanical strength becomes insufficient. Particularly due to the stress in the transverse direction accompanied by the stress in the vertical direction, the bridge breaks, which causes wrinkles in the shadow mask.

This problem is solved by the pair of protruding portions 22 in the present embodiment. As shown in FIGS. 2B and 2C, the distance between the upper and lower sides 22*a*, 22*b* of the vertical direction of the protruding portion 22 is increased gradually as it approaches from the base 22*c* to the tip 22*d*. The shielding effect against the electron beam can be obtained also in the case in which the protruding portion is formed into a rectangular shape as shown by dotted lines 24. However, by forming the protruding portion such that the width thereof gradually increases as mentioned above, the area for shielding the electron beam is increased considerably in the vicinity of a space portion 23 between the both tips of the protruding portions facing each other if compared with the case of forming a rectangular protruding portion.

Furthermore, in order to shield the electron beam even more, the width of the protruding portion simply can be increased totally. However, according to this embodiment, the width of the protruding portion is not increased totally, but instead, the tip is formed to be wider than the base. Due to this configuration, even if the electron beam is not shielded in the space portion, the electron beam can be shielded largely in the vicinity thereof. Thus, the shielding effect against the electron beam by the protruding portion can be obtained surely, and furthermore, while the shielding effect is secured in this way, the deterioration of luminance can be suppressed as much as possible.

Figure 3A:
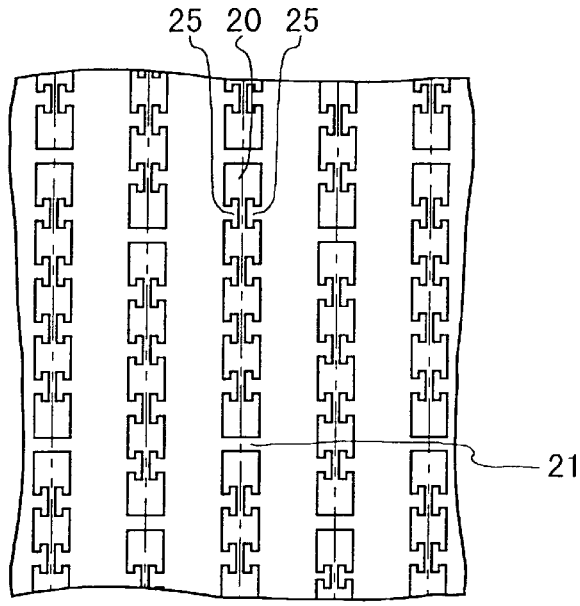
FIGS. 3A–C are plan views showing another shadow mask of Example 1 of the present invention.
Figure 3B:
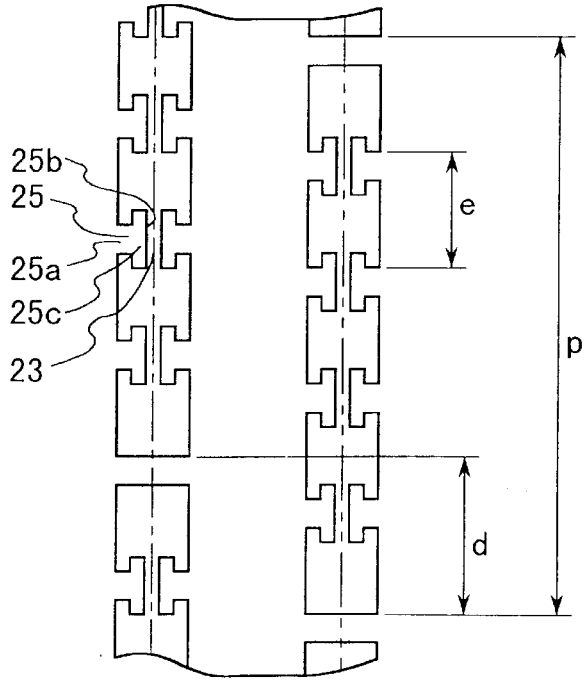
Figure 3C:
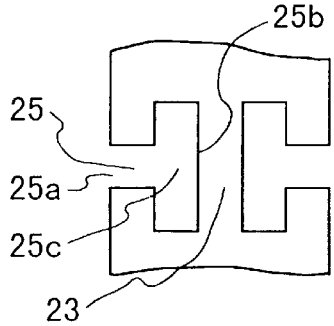

FIG. 3A shows another embodiment of a shadow mask. FIG. 3B is an enlarged view of one portion in FIG. 3A, and FIG. 3C shows an enlarged view of a protruding portion. As illustrated in FIGS. 3B and 3C, a protruding portion 25 is provided with an extending portion 25*c* on the side of a tip 25*b*, which is extending more in the vertical direction than a base 25*a*.

As the protruding portion 22 shown in FIG. 2, the protruding portion 25 shown in FIG. 3 also is formed such that the width of the protruding portion is not increased totally, but instead, the tip 25*b* is formed to be wider than the base 25*a*. In other words, while the deterioration of luminance is suppressed as much as possible, the area for shielding the electron beam is increased in the vicinity of the space portion 23, so that the shielding effect against the electron beam can be obtained surely, and the occurrence of moire stripes also can be suppressed.

By forming the protruding portions in the aperture as shown in FIGS. 2 and 3, while the vertical pitch of the bridge can be maintained at a large value, the occurrence of moire stripes can be suppressed in the same manner as the vertical pitch of the bridge is reduced and the number of the bridge is increased.

Furthermore, with regard to the protruding portions 22 and 25 in the embodiment as described above, the tips of the pair of the protruding portions facing each other are formed separately. Therefore, the thermal expansion in the horizontal direction is not transmitted between the protruding portions, and the doming can be prevented. In other words, according to this embodiment, it is possible to reduce the doming amount of the shadow mask to which a tension force is applied mainly in the vertical direction and also to suppress the occurrence of moire stripes at the same time.

Also to suppress the occurrence of moire stripes, the positions of the bridge and the protruding portion preferably are shifted in the vertical direction between aperture lines neighboring in the horizontal direction. Due to this displacement, a mutual intervention between scanning lines and aperture patterns can be suppressed, so that it is more effective in suppressing the occurrence of moire stripes. When an amount of displacement d between the neighboring bridges (FIGS. 2, 3) is reduced, the distance between the neighboring bridges on the same horizontal line is increased, so that it is effective in suppressing the occurrence of moire stripes in the horizontal direction. However, when this displacement is reduced too much, moire stripes in the oblique direction become noticeable. Therefore, the amount of displacement d preferably is in the range between ½ and ⅕ of the vertical pitch p (the vertical pitch of the bridge 21) of the aperture 20.

Furthermore, a vertical pitch e of the protruding portions 22, 25 preferably is 1 mm or less, and the vertical pitch p of the aperture 20 preferably is in the range between 1.5 and 30 mm. The reason is as follows.

In the cathode ray tube that is not provided with protruding portions inside the aperture, the following relationship is satisfied, where a moire wavelength is λ; a vertical pitch of the bridge is a; an interval between scanning lines is s; and an order of moire mode is n:

$$\lambda=1/(n/2s-s/a)$$

In the case of a plural broadcast system, in order to suppress moire stripes in the respective broadcast systems with the use of a single shadow mask structure, the compromise value of s/a is 9/8 for NTSC and 11/8 for PAL. Thus, if the vertical pitch a of the bridge is 1 mm or less, also for the plural broadcast system, it is possible to find a solution for suppressing the occurrence of moire stripes with one shadow mask structure.

In other words, when the vertical pitch a of the bridge is replaced with the vertical pitch e of the protruding portions 22, 25 of the present invention, then it is preferable that the vertical pitch e is 1 mm or less to suppress the occurrence of moire stripes.

Furthermore, when the vertical pitch p of the aperture 20 is within the above range, the doming amount can be reduced more than about 90 μm, as shown in FIG. 8. Moreover, while the luminance property and the mechanical strength are maintained constantly, the oscillation of the shadow mask can be controlled within the practical range.

In other words, when the vertical pitch p is reduced too much, the doming amount is increased greatly, and the luminance property also cannot be maintained. On the contrary, when the vertical pitch is increased too much, the doming amount is reduced, and the oscillation also increases due to the lack of sufficient mechanical strength. If it is within the above range, the oscillation can be suppressed to about the degree of a conventional press mask by press molding.

Furthermore, the area of the pair of the protruding portions 22, 25 preferably is in the range between 20 and 120% of the area for one piece of the bridge 21. This range is preferable since the occurrence of moire stripes can not be suppressed sufficiently if the area of the protruding portions is too small versus the bridge, whereas the luminance property is reduced if the area is too large.

In this embodiment, the pair of the protruding portions is formed separately, and the tips thereof are arranged facing each other. Due to this configuration, not only the effect described above can be obtained, but also another effect of improving the geomagnetic character can be obtained.

Hereinafter, the improvement of geomagnetic character will be explained. A cathode ray tube uses a member such as a magnetic shield to block magnetism from outside, so that an electron beam is not diverged too much from its original track by the magnetism from outside such as geomagnetism. Generally, the geomagnetic character refers to a color displacement of the electron beam caused by the geomagnetism. The shadow mask that selects colors also has the function of improving the geomagnetic character by blocking this magnetism from outside. In particular, the geomagnetism heading almost perpendicular to the panel of the cathode ray tube is transmitted along the shadow mask in the creepage direction so as not to have a direct effect on the electron beam.

Here, when the vertical pitch of the bridge in the shadow mask is too large, with regard to the shadow mask without any protruding portion provided in the aperture, the geomagnetism is transmitted easily in the vertical direction of the shadow mask but hardly in the horizontal direction due to the small number of bridges. Therefore, particularly in the peripheral portion where the frame and the shadow mask approach each other, the geomagnetism accumulated in the shadow mask may float in the tube direction. In addition, since the area of the aperture is large, the geomagnetism also often passes through the aperture directly. Due to these reasons, the track of the electron beam is changed, which easily causes a color displacement to occur.

On the other hand, according to this embodiment, the protruding portions approaching and facing each other are provided in the aperture, so that the both protruding portions facing each other play the role to pass over the geomagnetism. Accordingly, the geomagnetism is transmitted in the vertical direction as well as in the horizontal direction not only in the bridge portions but also in the protruding portions. Thus, the geomagnetism stops floating, and the geomagnetism that is trying to pass through the aperture also is picked up in this protruding portion. Due to this effect, the electron beam is less influenced by the geomagnetism. As a result, a cathode ray tube with less color displacement caused by geomagnetism can be obtained.

With regard to the size in the embodiment of FIG. 2, for example, the values are as follows: the vertical pitch e of the protruding portion 22 is 0.6 mm; the vertical pitch p of the aperture 20 is 3 mm; the width w of the bridge 21 in the vertical direction is 40 $\mu$m; the width s of the aperture 20 in the transverse direction is 200 $\mu$m; the width b2 of the tip 22*b* of the protruding portion 22 is 80 $\mu$m; and the width b1 of the base 22*c* is 40 $\mu$m.

The shape of the aperture 20 in FIGS. 2 and 3 shows an example of a rectangular shape, but the shape is not limited thereto and may be formed into a shape with round corners. The tip 22*d* of the protruding portion 22 shows an example with edge-shaped ends, but the both ends also may be formed into round shapes. Furthermore, the wide portion 25*c* of the protruding portion 25 has a rectangular shape in this example, but the shape is not limited thereto and also may be formed into a shape with round corners.

EXAMPLE 2

Figure 4A:
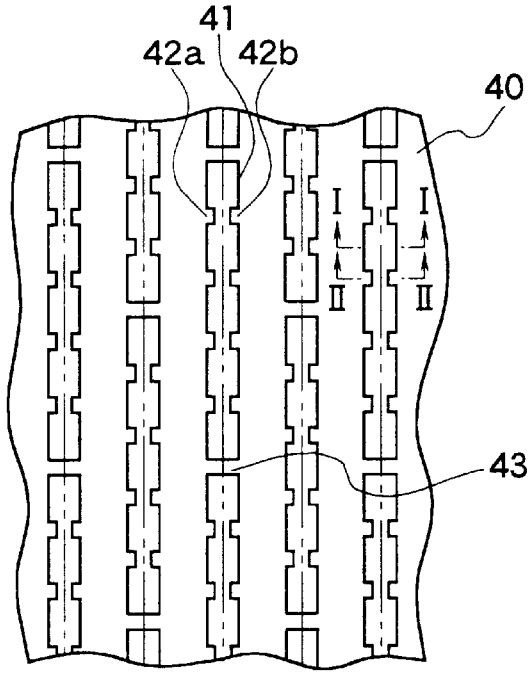
FIG. 4A is a plan view showing a shadow mask for explanation of Example 2 of the present invention.
Figure 4B:
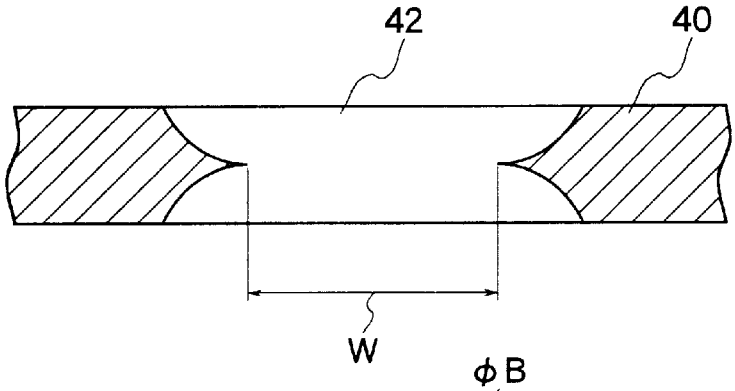
FIG. 4B is a cross-sectional view taken on line I—I of FIG. 4A.
Figure 4C:
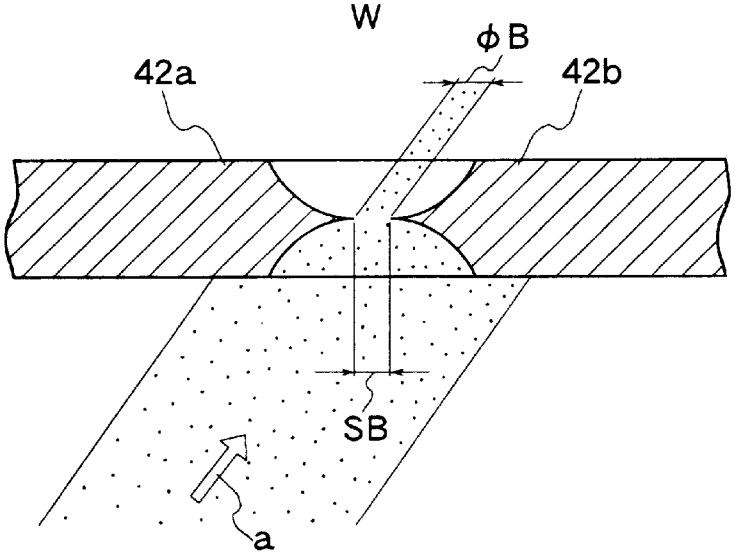
FIG. 4C is a cross-sectional view taken on line II—II of FIG. 4A.

Hereinafter, the present invention will be described by way of a second embodiment with reference to drawings. Also in this embodiment, the constitutions of the color-selecting electrode are the same as those in Example 1 explained with reference to FIG. 1. Furthermore, the shadow mask has protruding portions in apertures. Here, the relationship of the space width between the tips of the protruding portions with the shielding effect will be explained with reference to FIG. 4. In a shadow mask 40 shown in FIG. 4A, protruding portions 42*a*, 42*b* are provided in an aperture 41. FIG. 4B is a cross-sectional view taken on line I—I of FIG. 4A, and FIG. 4C is a cross-sectional view taken on line II—II of FIG. 4A. A width SB between the protruding portions 42*a* and 42*b* shown in FIG. 4C is narrower than a width W shown in FIG. 4B.

Therefore, as arrow a in FIG. 4C shows, a certain amount of the incident electron beam passes through the width SB and becomes the beam having a horizontal diameter $\phi$ B, and a considerable amount of the electron beam can be blocked. In this case, as the width SB is reduced, the shielding effect of blocking the electron beam is improved. In other words, this state resembles the state in which a bridge is formed in the aperture, so that the effects to suppress the occurrence of moire stripes also is improved. However, if the width SB is reduced further, the yield is reduced due to its complicated etching process.

There was namely a certain limitation with regard to reducing the distance between the tips of the protruding portions, so that the shielding effect also was limited to a certain degree.

The object of Example 2 is to improve the effect to suppress the occurrence of moire stripes even more, while reducing the doming amount and suppressing the occurrence of moire stripes at the same time.

Figure 5A:
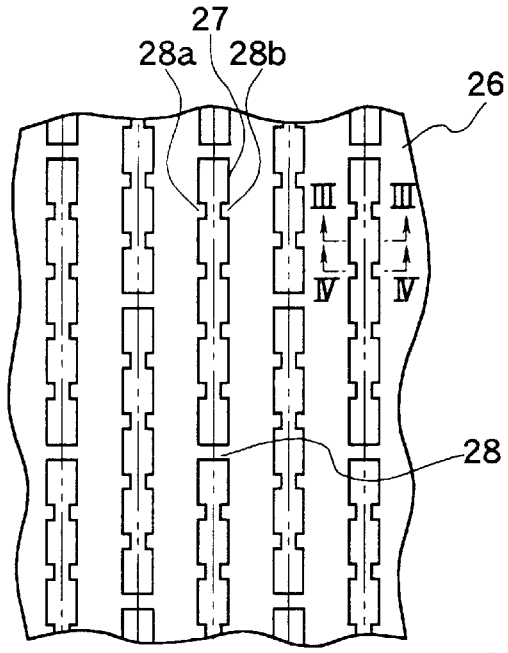
FIG. 5A is a plan view showing a shadow mask of Example 2 of the present invention.

FIG. 5A is a plan view showing a shadow mask of this embodiment. The neighboring substantially slot-shaped apertures 27 arranged in the vertical direction (vertical direction of the screen) are linked by a bridge 28. In the aperture 27, protruding portions 28*a* and 28*b* are formed. These protruding portions 28*a* and 28*b* are protruding from the both ends of the horizontal direction (horizontal direction of the screen) of the aperture 27. The protruding portions 28*a* and 28*b* are arranged facing each other at their tips. Since the protruding portions 28*a* and 28*b* are formed separately, the aperture 27 is narrowed in the horizontal direction in the area where these pairs of protruding portions 28*a* and 28*b* are formed.

Since the protruding portions 28*a* and 28*b* are formed, these protruding portions play the same role as the bridge, so that the occurrence of moire stripes can be suppressed in the same manner as the vertical pitch of the bridge 28 is reduced so as to increase the number of the bridge. In addition, the protruding portions 28*a* and 28*b* are formed separately. Therefore, the thermal expansion in the horizontal direction is not transmitted between the both protruding portions, and the doming can be prevented. In other words, according to this embodiment, it is possible to reduce the doming amount of the shadow mask to which a tension force is applied mainly in the vertical direction and also to suppress the occurrence of moire stripes at the same time.

Figure 5B:
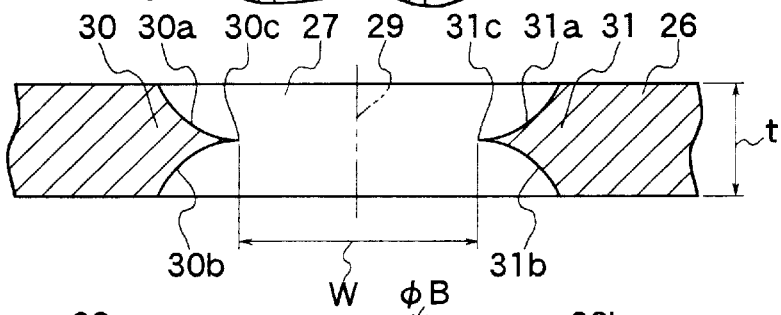
FIG. 5B is a cross-sectional view taken on line III—III of FIG. 5A.
Figure 5C:
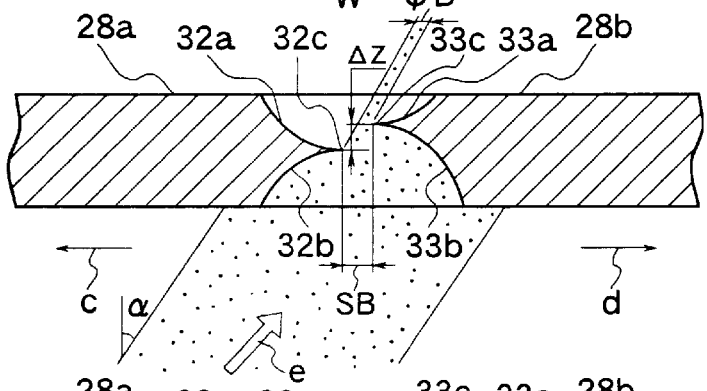
FIG. 5C is a cross-sectional view taken on line IV—IV of FIG. 5A.
Figure 5D:
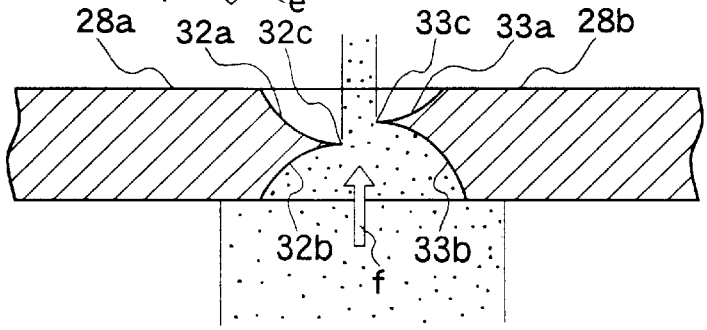
FIG. 5D is a drawing showing the state in which an electron beam entered in the vertical direction in FIG. 5C.

In this embodiment, while a certain distance between the tips of the protruding portions is secured, the shielding effect is improved further by providing the cross sections of the tips of the protruding portions with special features. Hereinafter, this embodiment will be explained by using FIG. 5B to FIG. 5D. FIG. 5B is a cross-sectional view taken on line III—III of FIG. 5A, i.e. a cross-sectional view of the full-width portion of the substantially slot-shaped aperture. FIG. 5C is a cross-sectional view taken on line IV—IV of FIG. 5A, i.e. a cross-sectional view of the protruding portion of the substantially slot-shaped aperture.

In the cross-sectional view shown in FIG. 5B, cross sections 30 and 31 in the internal circumference of the full-width portion of the aperture 27 are left-right symmetrical to a center line 29 of the aperture 27. The cross sections 30, 31 respectively have inclined portions 30*a* and 31*a* on the upper side of the thickness direction that become wider as they approach the upper side.

The cross sections 30, 31 respectively have inclined portions 30*b* and 31*b* on the lower side of the thickness direction that become wider as they approach the lower side. Furthermore, the inclined portions 30*a* and 30*b* respectively intersect at a tip portion 30*c*, and the inclined portions 31*a* and 31*b* respectively intersect at a tip portion 31*c*.

In the cross-sectional view shown in FIG. 5C, the ends of the protruding portions 28*a*, 28*b* in cross section basically are configured the same as the respective cross sections in the internal circumference of the full-width portion of the aperture shown in FIG. 5B. Also, inclined portions 32*a* and 32*b* respectively intersect at a tip portion 32*c*, and inclined portions 33*a* and 33*b* respectively intersect at a tip portion 33*c*.

However, the cross sections shown in FIG. 5C are different from those shown in FIG. 5B in that the tip portions 32*c*, 33*c* are positioned left-right asymmetrical to the center line 29, so that the cross sections 32, 33 are formed left-right asymmetrical to the center line 29.

The position of the tip portion 33*c* in the thickness direction is shifted upward by a distance ΔZ from the position of the tip portion 32*c* in the thickness direction. In FIG. 5C, the direction indicated by arrow c is the direction toward the center of the shadow mask, and the direction indicated by arrow d is the direction toward the periphery of the shadow mask. Therefore, due to the displacement of ΔZ, the inclined portion 33*b* on the peripheral side of the shadow mask is higher in the thickness direction than the inclined portion 32*b* on the central side of the shadow mask.

Accordingly, for example, an incident electron beam that is inclined as indicated by arrow e in FIG. 5C is blocked mostly by the inclined portion 33*b*, and moreover, the electron beam passes through with the horizontal diameter ϕ B is that is narrower than the width SB between the tip portions of the protruding portions. On the other hand, in the case of the cross sections illustrated in FIG. 4C, the incident electron beam that is inclined as indicated by arrow a passes through approximately with the same horizontal diameter ϕ B as the width SB between the tip portions of the protruding portions.

Namely, this embodiment is configured such that the aperture 27 is narrowed in the horizontal direction by the pair of the protruding portions 28*a*, 28*b*, and additionally, the positions of the tip portions 32*c*, 33*c* are shifted only at the distance ΔZ, so that the horizontal diameter of the electron beam can be reduced to be narrower than the width of the aperture in the horizontal direction in the area where the protruding portions are formed. As a result, the shielding effect can be improved considerably, and the occurrence of moire stripes can be suppressed even more.

Since the electron beam entering the aperture 27 has a larger degree of inclination as it approaches the periphery of the shadow mask in reference to the line vertical to the surface of the shadow mask, such shielding effect is higher on the peripheral side of the shadow mask than on the central side. For example, as indicated by arrow f in FIG. 5D, the electron beam enters perpendicularly in the central portion of the shadow mask, so that the shielding effect due to the displacement of ΔZ cannot be obtained.

Therefore, the central portion of the shadow mask may be provided with an area where the cross sections shown in FIG. 5C are not formed. For example, as shown in FIG. 1, this area may be provided in the range within the circle that has a central point A in the planar direction of the shadow mask and a diameter B. The diameter B preferably is, for example, not more than 70 mm.

Furthermore, the aperture may be formed so that the amount of displacement ΔZ is equal to the thickness t. In this case, the tip portion 32*c* namely is positioned at the edge on the back side of the shadow mask in the thickness direction, and the tip portion 33*c* is positioned at the edge on the front side of the shadow mask in the thickness direction. Accordingly, the respective cross sections have inclined portions that are inclined only in one direction.

In other words, according to this configuration, the inclined portion on the side of the tip portion 32*c* starts to incline from the tip portion 32*c* and inclines toward the central portion of the shadow mask 26 as it approaches the front side of the shadow mask 26. The inclined portion on the side of the tip portion 33*c* starts to incline from the tip portion 33*c* and inclines toward the peripheral side of the shadow mask 26 as it approaches the back side of the shadow mask 26.

As illustrated in FIG. 5C, the cross section preferably satisfies the following inequality (formula 1), where the incident angle (°) of an electron beam is α (α>0); the shortest distance (mm) in the horizontal direction between the portions facing each other via the aperture of the protruding portions is SB; the displacement (mm) between the tip portions of the pair of the protruding portions in the thickness direction of the shadow mask is ΔZ; and {1−(a horizontal diameter (mm) of the electron beam passing through the aperture)/(the shortest distance (mm) in the horizontal direction between the portions facing each other via the aperture)}×100 is a shielding rate B (%).

$$\sin\{90^\circ-\alpha-(\tan^{-1}\Delta Z/SB)\}\times(SB^2+\Delta Z^2)^{1/2}\leqq(\beta-B/100)\times SB \quad \text{(formula 1)}$$

Here, the horizontal diameter (mm) of the above-mentioned electron beam passing through the aperture corresponds to ϕ B in FIG. 5C.

In the example of the shadow mask having the thickness t=0.1 mm, when it is determined to be SB=0.04 mm, ΔZ=0.1 mm, and B=80%, the shadow mask satisfies the (formula 1) in the range of β≧17.5°. In other words, at least 80% of the shielding rate can be secured in the range of α≧17.5°. When the value of the shielding rate (%) B is determined to be lower, for example, in the range of B<80%, the range for obtaining such a shielding rate can be extended further to the central side.

Furthermore, when ΔZ=0.028 mm in the above example, at least 80% of the shielding rate can be secured in the range of β≧45.6°. This means that the range of α in which a constant shielding rate can be secured is varied also when SB is varied. In this way, when ΔZ and SB are determined by using the (formula 1), it is possible to change the range of α in which a constant shielding rate B can be secured.

The aperture provided with the protruding portions only having the displacement of ΔZ as in this embodiment can be formed by etching. To explain by referring to the example of FIG. 5C, for example, resist patterns on the front side and those on the back side of the shadow mask can be formed by shifting the center of the portion corresponding to the front hole formed by the inclined portions 32*a*, 33*a* and the center of the portion corresponding to the back hole formed by the inclined portions 32*b*, 33*b*.

Furthermore, the aforementioned embodiment is described as an example in which the protruding portions are protruding from the both ends to the inside of the aperture, but the protruding portions also may protruding only from one end of the aperture.

Moreover, the tip portion of the protruding portion in cross section was illustrated as an edge shape in this example, but the tip portion also may be formed as a portion with a flat or a curved surface.

Furthermore, the protruding portion in the planar direction was illustrated as a rectangular shape in this example, but it is not limited thereto. It is possible to form the aperture and the protruding portion to have round edges, or the protruding portion also may protrude gradually from the base to the tip. Such a shape with a gradual protrusion can be realized easily by the etching method used mainly for the production of shadow masks, so that it is practical.

According to the cathode ray tube of the present invention described above, by forming the protruding portions, the vertical pitch of the bridge is maintained at a large value, while the occurrence of moire stripes can be suppressed in the same manner as the vertical pitch of the bridge is reduced. Furthermore, the tips of the pair of the protruding portions facing each other are formed separately, so that the thermal expansion in the horizontal direction is not transmitted between the protruding portions, and the doming can be prevented. In other words, it is possible to reduce the doming amount and also to suppress the occurrence of moire stripes at the same time. In addition, since the tip of the protruding portion is wider than the base, it is possible to suppress the deterioration of luminance while securing the shielding effect against the electron beams.

Furthermore, by forming the portions facing each other via the aperture of the protruding portions to have asymmetrical cross sections in the horizontal direction, the effects to suppress the occurrence of moire stripes can be improved even more.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A cathode ray tube comprising a shadow mask made of a flat plate provided with a number of apertures and bridges between the neighboring apertures arranged in the vertical direction, wherein protruding portions protruding from both ends of the horizontal direction of the aperture to the inside of the aperture are formed in the shadow mask, and a tip of the protruding portion is wider than a base of the protruding portion.

2. The cathode ray tube according to claim 1, wherein a width of the protruding portion gradually increases from the base to the tip.

3. The cathode ray tube according to claim 1, wherein the tip of the protruding portion is extending more in the vertical direction than the base.

4. A cathode ray tube comprising a shadow mask made of a flat plate provided with a number of apertures and bridges between the neighboring apertures arranged in the vertical direction, an electron beam passing through the apertures, wherein protruding portions protruding from ends of the horizontal direction of the aperture to the inside of the aperture are formed in the shadow mask, and a horizontal diameter of the electron beam passing through the aperture is smaller than a shortest distance in the horizontal direction between the portions facing each other via the aperture in the area where the protruding portions are formed at least in the vicinity of both edges of the shadow mask in the horizontal direction.

5. The cathode ray tube according to claim 4, wherein the portions facing each other via the aperture in the area where the protruding portions are formed have horizontal cross sections asymmetrical to the center line of the aperture that is perpendicular to the surface of the shadow mask.

6. The cathode ray tube according to claim 4, wherein the protruding portions are protruding from the both ends of the horizontal direction of the aperture to the inside of the aperture, and tips of the protruding portions are facing each other.

7. The cathode ray tube according to claim 4, wherein one of the portions of the protruding portions facing each other via the aperture comprises an external wall portion positioned on the outer side of the shadow mask having a back inclining portion in the horizontal cross section inclining from a tip portion toward the outer side of the shadow mask as it approaches the back side of the shadow mask, and that the tip portion is positioned closer to the front side of the shadow mask than the center of the shadow mask in the thickness direction.

8. The cathode ray tube according to claim 7, wherein one of the portions of the protruding portions facing each other via the aperture comprises an internal wall portion positioned on the inner side of the shadow mask having a front inclining portion in the horizontal cross section inclining from a tip portion toward the inner side of the shadow mask as it approaches the front side of the shadow mask, and that the tip portion of the external wall portion is positioned closer to the front side of the shadow mask than the tip portion of the internal wall portion.

9. The cathode ray tube according to claim 8, wherein the following inequality is satisfied, where an incident angle (°) of an electron beam is $\alpha$ ($\alpha>0$) in reference to the line vertical to the surface of the shadow mask; a shortest distance (mm) in the horizontal direction between the portions facing each other via the aperture of the protruding portions is SB; a displacement (mm) between the tip portion of the external wall portion and the tip portion of the internal wall portion in the thickness direction of the shadow mask is $\Delta Z$; and {1−(a horizontal diameter (mm) of the electron beam passing through the aperture)/(the shortest distance (mm) in the horizontal direction between the portions facing each other via the aperture)}×100 is a shielding rate B (%):

$$\sin\{90^\circ-\alpha-(\tan^{-1}\Delta Z/SB)\}\times(SB^2+\Delta Z^2)^{1/2}\leqq(1-B/100)\times SB.$$

* * * * *